US007503688B2

(12) United States Patent
Hessler et al.

(10) Patent No.: US 7,503,688 B2
(45) Date of Patent: Mar. 17, 2009

(54) THERMOREGULATED SPRUNG BALANCE RESONATOR

(75) Inventors: Thierry Hessler, Renens (CH); Rudolf Dinger, Saint-Aubin (CH)

(73) Assignee: Asulab S.A., Marin (CH)

( * ) Notice: Subject to any disclaimer, the term of this patent is extended or adjusted under 35 U.S.C. 154(b) by 544 days.

(21) Appl. No.: 10/943,855

(22) Filed: Sep. 20, 2004

(65) Prior Publication Data

US 2005/0068852 A1 Mar. 31, 2005

(30) Foreign Application Priority Data

Sep. 26, 2003 (EP) ..... 03021787

(51) Int. Cl.
*G04B 17/00* (2006.01)
*G04B 17/04* (2006.01)

(52) U.S. Cl. ..... 368/169; 368/175

(58) Field of Classification Search ..... 368/168, 368/169, 175, 158, 159, 161, 162, 174, 127
See application file for complete search history.

(56) References Cited

U.S. PATENT DOCUMENTS 3,782,169 A * 1/1974 Simon-Vermot ..... 73/1.47
4,023,055 A * 5/1977 Tsukada ..... 310/370
4,410,827 A * 10/1983 Kogure ..... 310/370
6,849,991 B2 * 2/2005 Zhang et al. ..... 310/361
6,877,893 B2 * 4/2005 Mock et al. ..... 368/127
2003/0011119 A1 1/2003 Imai

FOREIGN PATENT DOCUMENTS

DE 19651321 A1 * 6/1998
EP 732 635 A1 9/1996
EP 1 302 821 A2 1/2003
FR 2842313 * 1/2004
JP 06117470 A * 4/1994

OTHER PUBLICATIONS

J S Danel et al, Quartz: a material for microdevices, Dec. 1991, Journal of Micromechanics and Microengineering, Issue 4, pp. 187-188.*

* cited by examiner

*Primary Examiner*—Vit W Miska
(74) *Attorney, Agent, or Firm*—Sughrue Mion, PLLC

(57) ABSTRACT

The balance-spring is structured by photolithography and etching in a strip pre-cut from a quartz monocrystal such that the height h of the coils form, with the crystallographic axis z, an angle θ for adapting the thermal behaviour of the balance-spring to that of the balance, thereby reducing the variation of rate due to temperature variations.

5 Claims, 2 Drawing Sheets

THERMOREGULATED SPRUNG BALANCE RESONATOR

This application claims priority from European Patent Application No 03021787.1 filed Sep. 26, 2003, the entire disclosure of which is incorporated herein by reference.

BACKGROUND OF THE INVENTION

The present invention concerns a thermoregulated sprung balance resonator for reducing the daily rate thermal variation of a mechanical watch movement to a level comparable to that of an electronic quartz watch.

DESCRIPTION OF THE INVENTION

It is well known that the variation of daily rate of a mechanical movement essentially depends upon the regulating members, and particularly the sprung balance whose oscillation frequency can be influenced by variations in external factors, such as a change in temperature or the presence of a magnetic field. The temperature acts particularly both on the moment of inertia of the balance and on the elasticity constant of the spiral, and alters the frequency of the sprung balance, which is actually a function of these two parameters.

As regards the balance, it is generally made of a non-magnetic alloy, such as glucydur, so that the oscillating movement of the balance cannot be disturbed by the proximity of magnetic materials. In order to minimise the influence of the temperature on the moment of inertia of the balance, i.e. on the variation of its radius of gyration, a very large number of devices have been proposed since the 1900s, these devices being essentially based on the principle of the cut bimetallic balance.

These devices will not be described further, given that the invention does not concern the geometrical features of the balance as such.

As regards the balance-spring, it has been known for a long time, in a manner that is still considered satisfactory, how to minimise the variations of rate due to variations in temperature by manufacturing balance-springs in alloys whose elasticity remains practically constant within the range of usual use temperatures. These are particularly iron-nickel alloys also containing chromium and titanium as hardening agents as well as various other elements (C, Mo, Be, etc.). Such alloys, better known by names such as "Elinvar", when of the highest quality, allow a variation of rate of ±0.6 second per degree in 24 hours to be obtained, but can still be sensitive to the effect of a magnetic field. Moreover, their manufacture relies on complex metallurgic processes that do not guarantee perfect reproducibility of the desired features, such that it is still necessary to match the balance and the balance-spring when they are assembled.

SUMMARY OF THE INVENTION

It is an object of the invention to overcome the drawbacks of the aforecited prior art by providing a sprung balance having a smaller still variation of rate owing particularly to a balance-spring made of a non-magnetic material wherein the coefficient of thermal expansion and thermal variation of the elasticity module allow, during manufacture, the elasticity constant of said balance-spring to be adapted to the moment of inertia of the balance.

It will be recalled that the elasticity constant of the balance-spring, otherwise designated by the "unitary torque of the balance-spring" answers formula I:

$$C = \frac{Ehe^3}{12L} \tag{I}$$

wherein E is the modulus of elasticity, h the height of the balance-spring, e its thickness and L its developed length. The frequency of the sprung balance can be connected to formula I by formula II:

$$f = \frac{1}{2\pi}\sqrt{\frac{C}{I}} \tag{II}$$

wherein I represents the moment of inertia of the balance, corresponding to formula III:

$$I = mr^2 \tag{III}$$

wherein m represents the mass and r the radius of gyration, which evidently depends upon the coefficient of thermal expansion $\alpha$ of the balance.

The invention therefore concerns a sprung balance for a mechanical watch movement wherein the balance-spring is formed of coils of height h made from a quartz monocrystal with crystallographic axes x, y, z, axis x, being the electrical axis and axis y the mechanical axis, the height h of the coils having substantially the same orientation as the crystallographic axis z. More precisely, height h forms with axis z, an angle $\theta$, which can vary between +25° and −25°, preferably between +10° and −15°, which allows the elasticity constant of the balance-spring to be altered without altering its geometry.

Owing to this design of the balance-spring, it is thus possible to adapt the elasticity constant of said balance-spring (formula I) very simply to the linear coefficient of thermal expansion $\alpha$ of the balance, which alters the moment of inertia (formula III) of said balance, so that the frequency (formula II) of the sprung balance resonator is thermoregulated.

The use of quartz for manufacturing a balance-spring also offers the advantage, in addition to its excellent thermal features, of possessing excellent mechanical and chemical properties, in particular as regards aging, oxidisation and sensitivity to magnetic fields.

The invention also concerns a method of manufacturing such a balance-spring, comprising the steps of:

- cutting, from a quartz bar with crystallographic axes x y z, a strip whose thickness will be thinned to a desired height h for the coils;
- forming a mask, whose contour delimits the desired shape of the balance-spring, by photolithography at the surface of the strip;
- etching by a wet or dry method to remove the quartz located outside the contour created, and releasing the balance-spring.

The photolithography and etching technique allows, on the one hand, the attachment of the balance-spring to the exterior and the collet at the centre to be formed in the quartz strip, at the same time as the balance-spring itself, and on the other hand other parameters to be chosen for the balance-spring, such as the thickness e of the coils and their pitch, at any point in its development.

In order to alter the elasticity torque of the balance-spring and adapt it to the linear coefficient of thermal expansion of a given balance, the quartz strip is cut along a plane forming an angle $\Pi/2-\theta$ with respect to crystallographic axis z, namely in an equivalent manner by forming via rotation about axis x, an angle $\theta$ with respect to the direction of height h of the balance-spring.

BRIEF DESCRIPTION OF THE DRAWINGS

Other features and advantages of the present invention will appear in the following description, given by way of non-limiting illustration with reference to the annexed drawings, in which.

DETAILED DESCRIPTION OF THE INVENTION

Figure 1:
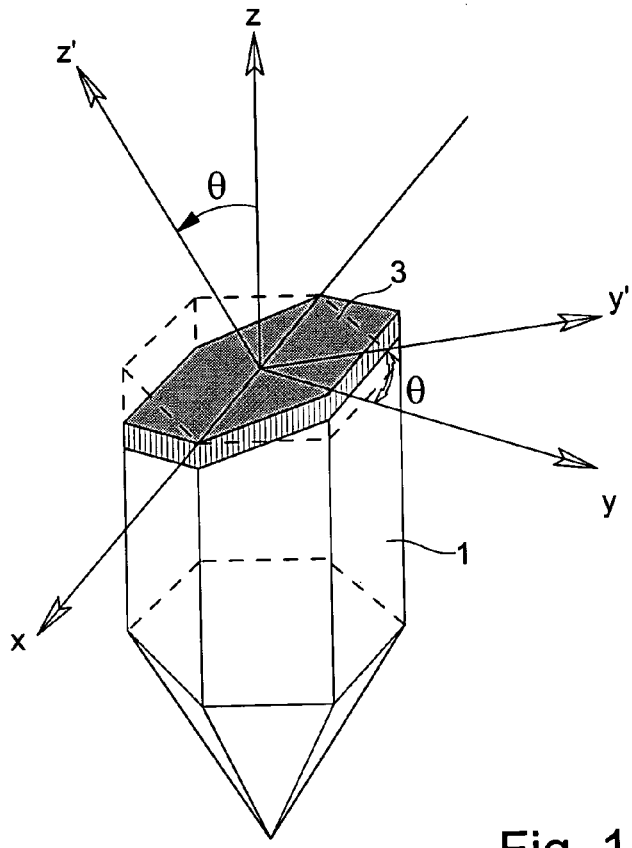
FIGS. 1 and 2 show the essential steps of the method of manufacturing a quartz balance-spring according to the invention.

FIG. 1 shows the first step of the method of manufacturing a balance-spring according to the invention. This step consists in taking a quartz bar 1 having crystallographic axes x y z, and cutting out a strip 3 having as its thickness the desired height h for strip 3, for example several tens of a millimetre. The precise desired height h can be obtained by cutting out a blank which is then subjected, in a known manner, to a machining operation by chemical, physical or physico-chemical means to thin the strip to height h. This strip is cut along a plane x y' forming an angle $\theta$ with the plane x y perpendicular to crystallographic axis z, i.e. by rotating plane x y by an angle $\theta$ about axis x.

Figure 2:
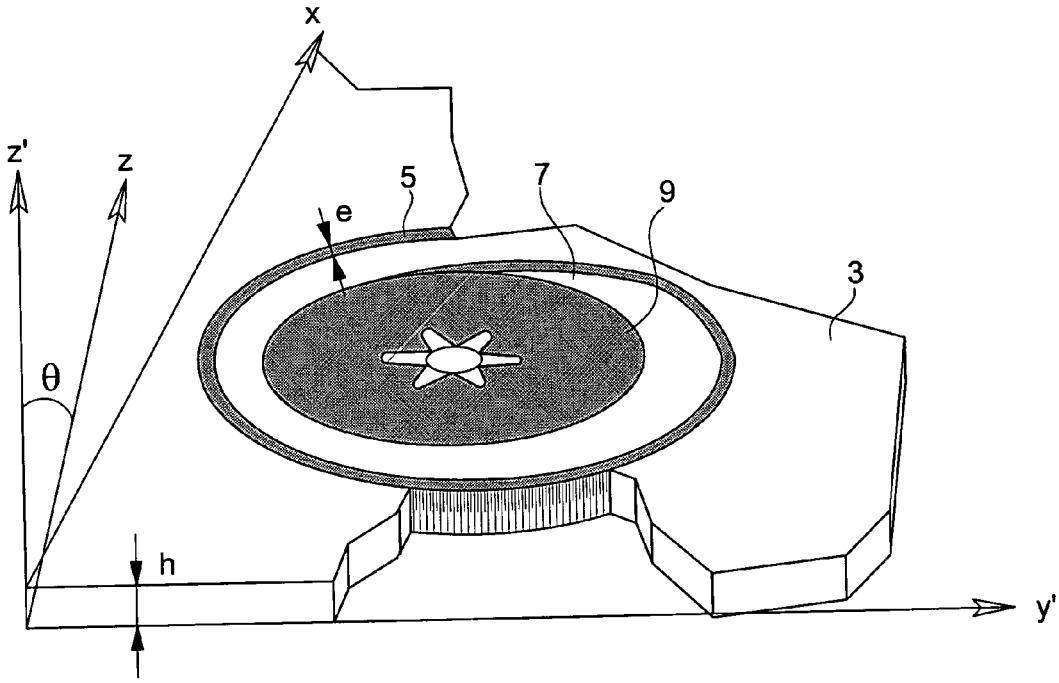

As can be seen in FIG. 2 showing a flat portion of this same strip 3, the direction of height h along axis z' forms an angle $\theta$ with crystallographic axis z.

FIG. 2 also shows schematically, for an enlarged balance-spring portion close to the curve at the centre, the following steps of the method. These steps consist, in accordance with known methods for manufacturing microstructures, in forming a mask by photolithography for delimiting contour 5 of the balance-spring, and defining outside said contour zones 7 that have to be removed to create the balance-spring.

If one wishes, the photolithography and etching method allows the attachment to the exterior and the attachment to the centre to be formed at the same time, i.e. a ring or collet integral with the balance-spring. It also allows other parameters to be freely chosen for the balance-spring to improve its efficiency, such as the thickness of the coils and/or their pitch, at any point during development of the balance-spring.

Removal of zones 7 located outside the contour can be carried out in accordance with known methods, for example for manufacturing tuning forks for electronic watches. Wet method etching in particular etching by means of a mixture of hydrofluoric acid and ammonium fluoride ($HF/NH_4F$) can be carried out. Dry etching can also be carried out, in particular by using the reactive ionic etching method.

Figure 3:
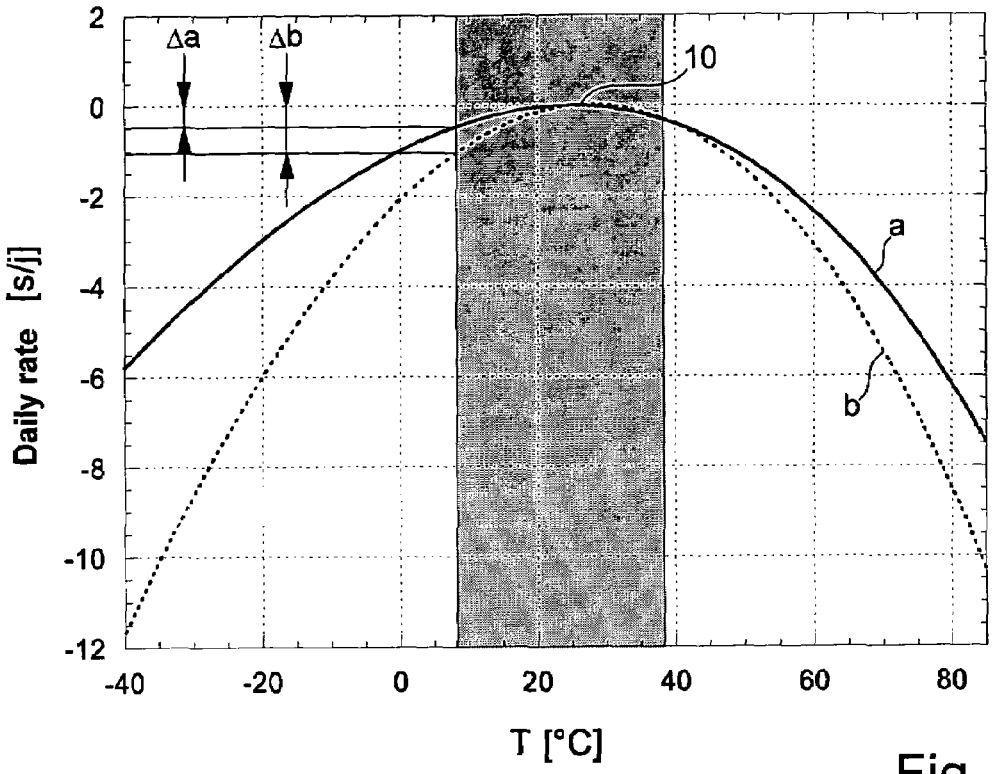
FIG. 3 is a graph showing the variation of rate as a function of the temperature of a quartz balance-spring according to the invention, with a comparison curve.

With reference now to FIG. 3, the variation of rate has been shown in seconds per day as a function of temperature for a quartz balance-spring (curve a) when the balance is made of a material having a coefficient of thermal expansion $\alpha=14\ 10^{-6}K^{-1}$ and a tuning fork for an electronic watch (curve b), both manufactured with an angle $\theta=2°$. There is also shown in vertical lines the temperature range to be retained for the purpose of comparison in accordance with the COSC standards (Contrôle Officiel Suisse des Chronomètres), namely between +8° C. and +38° C. It will be observed that the curves a and b are very close to each other within the COSC range, the maximum variation from turning over point 10 having respectively the values of a $\Delta a=0.5$ seconds per day and $\Delta b=1.2$ seconds per day.

Figure 4:
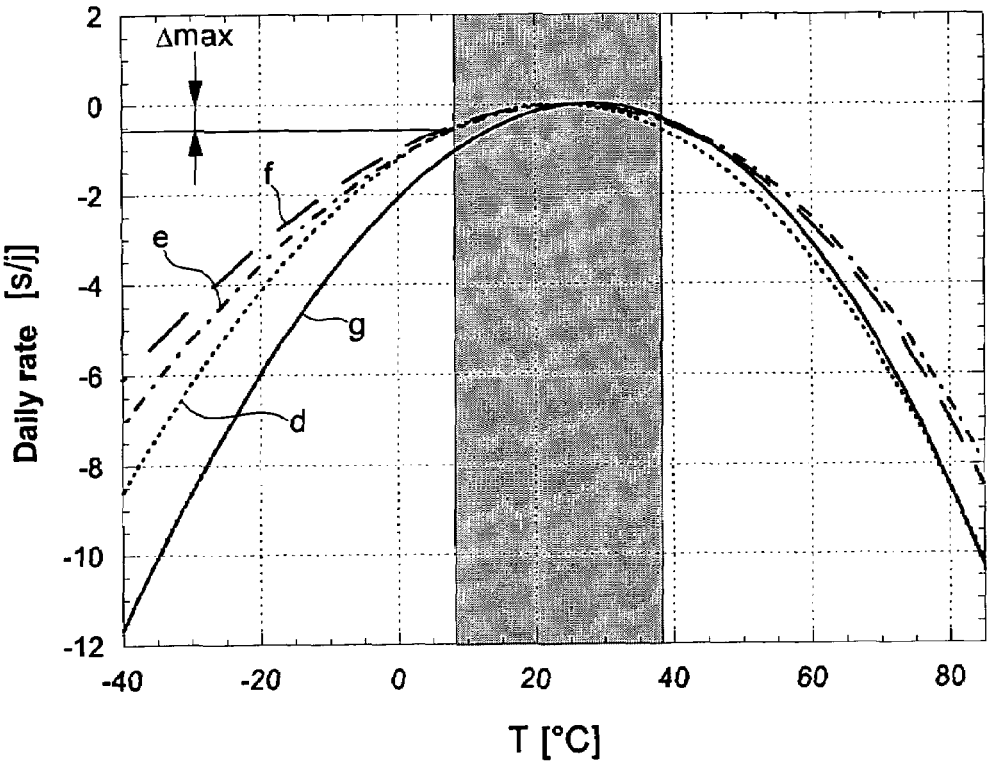
FIG. 4 is a graph comparable to that of FIG. 3 in which the balance-spring is made of quartz strips cut along different cutting angles.

FIG. 4 shows a group of curves giving the variation rate as a function of temperature and showing how it is possible, by a simple variation in angle $\theta$, to obtain a minimum variation of rate with balances having different coefficients of thermal expansion, as indicated in table 1 hereinafter:

TABLE 1

| | Thermal expansion coefficient $\alpha$ | Angle $\theta$ |
|---|---|---|
| curve d | $5.10^{-6}\,K^{-1}$ | −14.6° |
| curve e | $10.10^{-6}\,K^{-1}$ | −7° |
| curve f | $15.10^{-6}\,K^{-1}$ | +7° |

Curve g corresponds to the tuning fork of an electronic watch taken as reference.

It will be observed that, within the COSC range covering 30° C., the maximum variation is approximately $\Delta max=-0.6$ seconds per day, i.e. again of the order of 0.02 seconds per degree in 24 hours, a much lower value than that which can be obtained with a metallic balance-spring of the highest quality.

What is claimed is:

1. A sprung balance resonator for a mechanical watch movement including a balance-spring with an elasticity constant C and a balance with a moment of inertia I, wherein the balance-spring is formed of coils of height h made from a strip of a single quartz monocrystal, and wherein the quartz is in crystallised form along crystallographic axes x y z, axis x being the electrical axis and y the mechanical axis.

2. The sprung balance resonator according to claim 1, wherein the strip of quartz is cut along a plane x y' formed by rotating plane x y by an angle $\theta$ about axis x.

3. The sprung balance resonator according to claim 2, wherein the angle $\theta$ has a value comprised between +25° and −25°, preferably between +10° and −15°.

4. The sprung balance resonator according to claim 3, wherein the limit values of angle $\theta$ allow the elasticity constant of said balance-spring to be adjusted to the thermal expansion coefficient of the balance.

5. The sprung balance resonator according to claim 2, wherein the elasticity constant C of the balance-spring and the moment of inertia I of the balance are matched, as regards their thermal features, by selecting an appropriate value for angle $\theta$.

* * * * *